US006941099B2

(12) United States Patent
Iwata

(10) Patent No.: US 6,941,099 B2
(45) Date of Patent: Sep. 6, 2005

(54) DEVELOPING DEVICE HAVING PLURALITY OF BIASED MAGNETIC SLEEVES

(75) Inventor: Naoki Iwata, Saitama-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/289,315

(22) Filed: Nov. 7, 2002

(65) Prior Publication Data

US 2003/0086727 A1 May 8, 2003

(30) Foreign Application Priority Data

Nov. 8, 2001 (JP) ..... 2001-342967

(51) Int. Cl.[7] ..... G03G 15/09
(52) U.S. Cl. ..... 399/269; 399/55; 399/270
(58) Field of Search ..... 399/53, 55, 267, 399/269, 270

(56) References Cited

U.S. PATENT DOCUMENTS

| | | | | |
|---|---|---|---|---|
| 4,265,197 A | * | 5/1981 | Toyono et al. | 399/269 |
| 5,172,169 A | | 12/1992 | Takashima et al. | |
| 5,187,535 A | * | 2/1993 | Tajima | |
| 5,220,383 A | | 6/1993 | Enoki et al. | |
| 5,239,344 A | | 8/1993 | Enoki et al. | |
| 5,241,357 A | | 8/1993 | Iwata | |
| 5,245,391 A | | 9/1993 | Suzuki et al. | |
| 5,286,918 A | | 2/1994 | Iwata et al. | |
| 5,311,263 A | | 5/1994 | Suzuki et al. | |
| 5,339,141 A | | 8/1994 | Suzuki et al. | |
| 5,424,811 A | * | 6/1995 | Haneda | 399/270 |
| 5,424,814 A | | 6/1995 | Suzuki et al. | |
| 5,450,172 A | | 9/1995 | Suzuki et al. | |
| 5,474,869 A | | 12/1995 | Tomita et al. | |
| 5,502,552 A | | 3/1996 | Iwata et al. | |
| 5,541,029 A | | 7/1996 | Iwata et al. | |
| 5,557,371 A | * | 9/1996 | Tooda | 399/279 |
| 5,557,392 A | | 9/1996 | Iwata | |
| 5,674,408 A | | 10/1997 | Suzuki et al. | |
| 5,741,616 A | | 4/1998 | Hirano et al. | |
| 5,809,386 A | | 9/1998 | Iwata | |
| 5,812,917 A | | 9/1998 | Iwata et al. | |
| 5,869,213 A | | 2/1999 | Iwata et al. | |
| 5,911,098 A | * | 6/1999 | Gyotoku et al. | 399/269 |
| 6,167,228 A | * | 12/2000 | German et al. | 399/269 |

FOREIGN PATENT DOCUMENTS

| | | | | |
|---|---|---|---|---|
| JP | 04184375 A | * | 7/1992 | G03G/15/08 |
| JP | 06161211 A | * | 6/1994 | G03G/15/02 |
| JP | 08-278691 | | 10/1996 | |
| JP | 10-026879 | | 1/1998 | |
| JP | 2000172043 A | * | 6/2000 | G03G/15/01 |
| JP | 2000-214686 | | 8/2000 | |
| JP | 2000214686 A | * | 8/2000 | G03G/15/09 |

OTHER PUBLICATIONS

Translation of Kusumoto JP2000–214686.*

* cited by examiner

*Primary Examiner*—Arthur T. Grimley
*Assistant Examiner*—Ryan Gleitz
(74) *Attorney, Agent, or Firm*—Oblon, Spivak, McClelland, Maier & Neustadt, P.C.

(57) ABSTRACT

A developing device having a plurality of sleeves is provided for high-speed development and the prevention of an abnormal image, for example, thinning of a line image. An AC bias is effectively applied, so that the base contamination is suppressed to obtain a smooth image without obvious grains. Among the plural sleeves, a bias towards the photoreceptor side is applied to an upstream-side sleeve, and a bias in the reverse direction is applied to a downstream-side sleeve. Alternatively, an AC bias with a low frequency is applied to the upstream-side sleeve and an AC bias with a high frequency is applied to the downstream-side sleeve. In addition, an AC bias with a large amplitude is applied to the upstream-side sleeve, and an AC bias with a small amplitude is applied to the downstream-side sleeve.

3 Claims, 2 Drawing Sheets

DEVELOPING DEVICE HAVING PLURALITY OF BIASED MAGNETIC SLEEVES

CROSS-REFERENCE TO RELATED APPLICATION

This application claims the priority benefit of Japanese application serial no. 2001-342967, filed on Nov. 8, 2001.

BACKGROUND OF THE INVENTION

1. Field of the Invention

This invention relates in general to a developing device used in an electrophotographic type image forming device. More particularly, the invention relates to a developing device of two-component developing manner where toner and carrier are stirred and a magnetic brush is formed on a sleeve in which magnets are enclosed to perform the development.

2. Description of Related Art

In a two-component developing device where the toner and the carrier are stirred and the magnetic brush of the carrier is made opposite to the surface of a photoreceptor to perform the development, a plurality of sleeves having magnets therein are provided, so that the development is performed while the magnetic brush crosses among the sleeves.

Because the development performance using only one single sleeve is better than that using a plurality of sleeves, a large linear velocity ratio of the sleeve to the photoreceptor is not required when the image forming device uses the aforementioned developing device. Therefore, even though for an imaging device where the photoreceptor rotates with a high speed to create a lot of sheets of output images per minute, no over load imparts on the developing motor or the bearings, etc., and therefore, the mechanical life time and the reliability can be improved. In addition, on the image, if the linear velocity ratio of the sleeve to the photoreceptor is small, the scavenging effect at the magnetic brush is strong enough that the effect of preventing the abnormal image, for example, the blur at the rear end of a solid image or the thinning of a line image, can be improved.

However, as the linear velocity ratio of the sleeve to the photoreceptor gets smaller and smaller, the scavenging effect with respect to the base surface of the photoreceptor gets weak and there is a problem that the base contamination is greatly created. Furthermore, because the developing performance is good, as the toner adhesion amount on the dot portion and the line portion increases, the unevenness of the adhesion amount also increases, so that the size of dot on the paper after being fixed becomes uneven. Additionally, even though on the vertical line portion, the scavenging effect gets weak and there is a problem that the roughness gets large easily after the fixing process.

Regarding the toner adhesion unevenness as described above, in general, an AC bias is applied to uniformize the toner adhesion, so as to obtain a smooth half tone image whose grain characteristic is suppressed. When a plurality of sleeves is used, the development performance gets better, but the development performance can be further increased if an AC bias is further applied. In this way, because the toner adhesion amount to the dot or the line is too much, the effect that the grain characteristic is suppressed by the AC bias cannot be obtained.

The Japanese Laid Open No. 2000-81790 provides a technology that the magnetization strength of the carrier of the two-component developer is regulated, so that a good image without being disturbed on the half tone portion can be obtained. In addition, according to the Japanese Laid Open No. 2000-293023, a blank pulse bias is used in the development using the two-component developer. Because the grain size of the consumed toner is different with time, a technology to set a mode such that the toner with a small grain size is forced to be consumed is provided. Furthermore, in the Japanese Laid Open No. 2000-321852, a photoreceptor with a surface layer having a volume resistance rate of $10^9$~$10^{14}$ Ωcm is used. By using a developing bias that an AC voltage is overlapped to a DC voltage and the AC frequency is set above 4 kHz when developing, the charge injection from the carrier to the surface of the photoreceptor can be avoided.

SUMMARY OF THE INVENTION

According to the foregoing description, an object of this invention is to provide a developing device having a plurality of sleeves, and high-speed development is possible. The developing device is provided to be able to prevent the abnormal image, for example, the blur at the rear end of a solid image or a thinning of the line image. An AC bias is effectively applied, so that the base contamination is suppressed to obtain a smooth image without obvious grains.

According to the object(s) mentioned above, the present invention provides a developing device. The developing device comprises a plurality of sleeves, each of which has magnets therein, wherein stirred toner and carriers are supported on the sleeves to form a magnetic brush to perform a developing process. A developing bias that is a DC overlapped with an AC bias is applied to the sleeve. Among the sleeves, a DC overlapping level of a bias applied to an upstream-side sleeve is different from a DC overlapping level of a bias applied to a downstream-side sleeve.

The present invention further provides a developing device. The developing device comprises a plurality of sleeves, each of which has magnets therein, wherein stirred toner and carriers are supported on the sleeves to form a magnetic brush to perform a developing process. A developing bias that is a DC overlapped with a AC bias is applied to the sleeve. Among the sleeves, a frequency of a bias applied to an upstream-side sleeve is different from a frequency of a bias applied to a downstream-side sleeve.

The present invention further provides a developing device. The developing device comprises a plurality of sleeves, each of which has magnets therein, wherein stirred toner and carriers are supported on the sleeves to form a magnetic brush to perform a developing process. A developing bias that is a DC overlapped with an AC bias is applied to the sleeve. Among the sleeves, an amplitude of a frequency of a bias applied to an upstream-side sleeve is different from an amplitude of a frequency of a bias applied to a downstream-side sleeve.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

Figure 1:
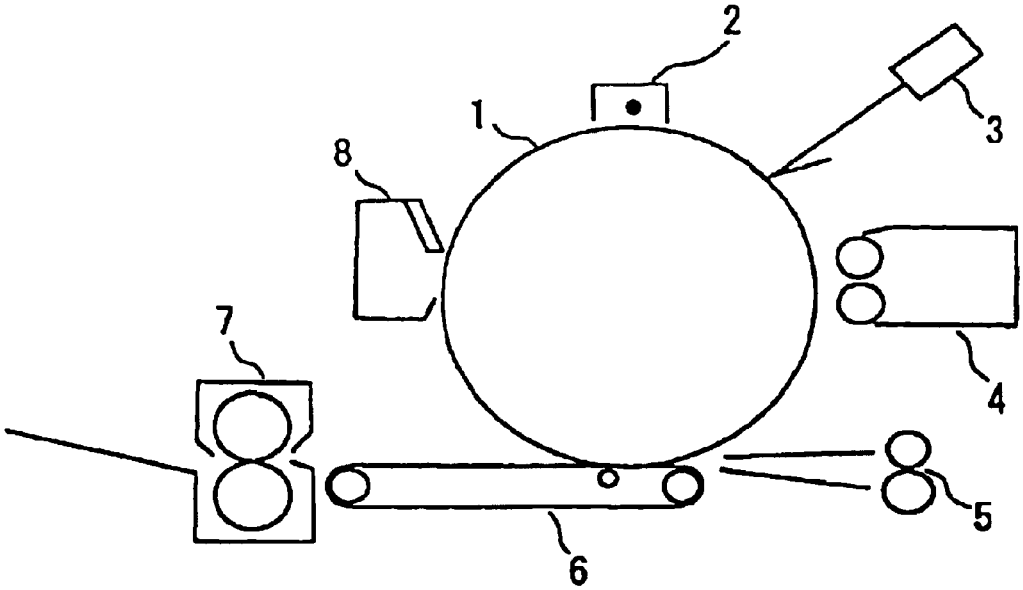
FIG. 1 is a schematic diagram of an image forming device using a developing device of the present invention.

The preferred embodiment of the present invention is described in detail accompanied with the attached drawings. FIG. 1 is a schematic diagram of an image forming device using a developing device of the present invention. Referring to FIG. 1, the surface of the photoreceptor 1 is uniformly charged by a charging device 2. The surface of the photoreceptor corresponding to an image data is exposed by a laser beam from an exposure device 3 (for example, a light emitting device of a semiconductor laser) to form an electrostatic latent image. Then, by using the developing device 4, the electrostatic latent image is reversely developed (negative to positive, vice versa) by the toner that is charged to possess the same polarity as the surface of the photoreceptor 1, so as to form a toner image. A transfer paper, which is transported on a transporting passage 5, is sandwiched between a transfer belt 6 and the photoreceptor 1 and a transfer current is applied thereon. In this manner, the toner image on the photoreceptor 1 is transferred onto the transfer paper. Afterwards, the transfer paper is electrostatically attracted onto the transfer belt 6 to be transported. When the transfer paper passes a fixing device 7, the toner is melted, hardened and the fixed on the transfer paper. The residual toner remaining on the photoreceptor 1 is made to fall into a cleaning unit 8 by a cleaning blade. Therefore, the surface of the photoreceptor 1 can be used again for image formation.

Figure 2:
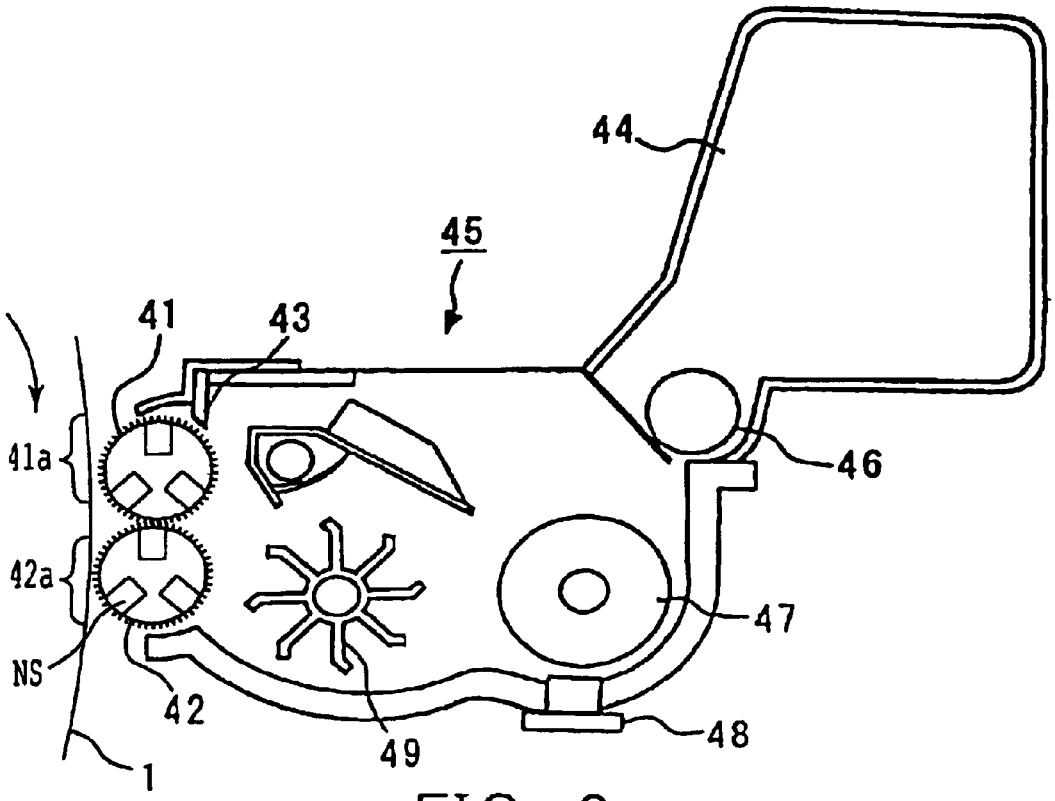
FIG. 2 is a schematic diagram of the developing device according to the present invention.

FIG. 2 is a schematic diagram of the developing device according to the present invention. The toner is received within a toner hopper 44, and is ejected into a developing unit 45 due to the rotation of a supplying roller 46. The ejected toner is mixed with the magnetic carrier by a stirring paddle 47, charged by friction and then adhered onto the carrier. Then, the toner is transported to the upper portion of an upstream-side sleeve 41 by a vertical stirring paddle 49. The transported carrier and toner are adhered on the upstream-side sleeve 41 by the magnet effect in upstream-side sleeve 41, so as to form a magnetic brush 41*a*. The napped length is suitably arranged by the doctor blade 43, and then the toner is transported to the imaging region. The electrostatic latent image on the photoreceptor 1 is to be developed by the scrape of the magnetic brush. The toner and carrier that form the magnetic brush on the upstream-side sleeve 41 goes over to the downstream-side sleeve 42, at which the magnetic brush 42*a* is formed again to perform the developing process. The toner concentration in the developing unit 45 is detected by a magnetic sensor 48, so that a rotation time of the supplying roller 46 is determined according to a reduction extent of the toner concentration to optimize the control of the toner concentration.

In the present invention, a DC bias overlapped with an AC bias is applied to the upstream-side sleeve 41 and the downstream-side sleeve 42 in the developing device 4. The DC bias overlapped with an AC bias is composed of a developing electric field and a reverse electric field, wherein the developing electric field has a level to make the toner to be transferred onto an image portion and a non-image portion on the photoreceptor 1 at the developing region, and the reverse electric field has a level to make the toner that is transferred to the non-image portion on the photoreceptor 1 to return to the upstream-side sleeve 41 and the downstream-side sleeve 42. Among the toner transferred onto the photoreceptor 1, since that transferred onto the image portion or a low contrast portion is made to selectively remain, an exact toner image can be formed on the electrostatic latent image.

The AC bias can be a sinusoidal wave, a rectangular wave, or other suitable wave. In this way, by the plural sleeves and the vibration effect of the AC electric field, the developing performance becomes very good. The linear velocity ratio with respect to the photoreceptor 1 for each sleeve is 1.1~1.8 and is sufficient. In this way, the image formation can be executed with a high linear velocity. In addition, the rear end of a solid image is blurred or a line image gets thinner, an abnormal image particularly occurring when the two-component developer is used, can be suppressed.

Moreover, according to the present invention, the DC overlapping levels for the DC overlapping AC bias respectively applied to the upstream-side sleeve 41 and the downstream-side sleeve 42 are different.

Figure 3:
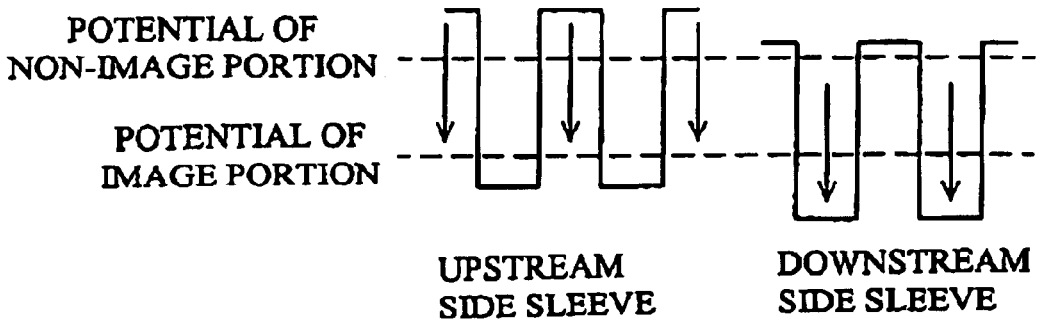
FIG. 3 is a pattern showing the bias applied to the upstream-side sleeve and the downstream-side sleeve.

FIG. 3 is a pattern showing the bias applied to the upstream-side sleeve 41 and the downstream-side sleeve 42. A strong electric field (the arrow in the drawing) with respect to the image portion on the photoreceptor I is applied to the upstream-side sleeve 41. In addition, a strong electric field in a direction where the toner adhered on the non-image portion returns to the downstream-side sleeve 42 (the arrow in the drawing) is applied to the downstream-side sleeve 42. In this way, the upstream-side sleeve 41 develops as far as the electrostatic latent image near the base of the photoreceptor 1, so that a toner adhesion with a high reality is conducted on the electrostatic latent image. The toner on the base or the surplus toner adhered on the dot portion, etc., returns by the downstream-side sleeve 42 along the sleeve direction so that the amount of the adhered toner can be uniform. By applying AC electric field to the plurality of sleeves, high-speed development is possible. The abnormal image, such as the blur occurring at the rear end of the solid image, etc., can be avoided. The base contamination can be suppressed and the grain is not obvious, so that a smooth image can be obtained.

Furthermore, the frequencies of the DC overlapping AC bias respectively applied to the upstream-side sleeve 41 and the downstream-side sleeve 42 are different.

Figure 4:
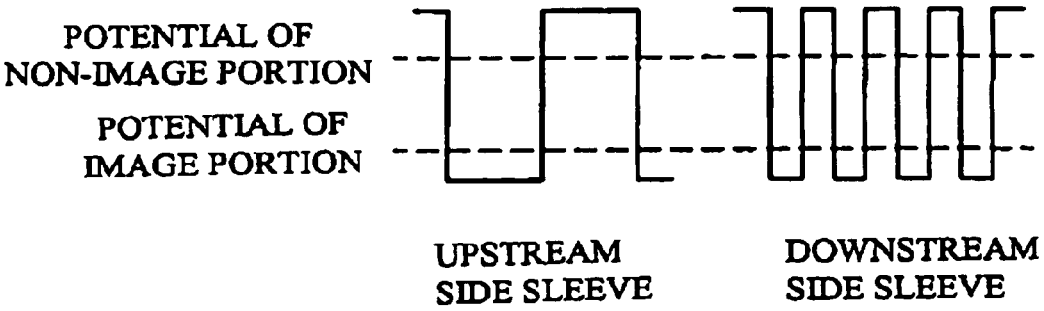
FIG. 4 is a pattern showing the bias applied to the upstream-side sleeve and the downstream-side sleeve.

FIG. 4 is a pattern showing the bias applied to the upstream-side sleeve 41 and the downstream-side sleeve 42. A sufficient amount of toner is transferred to the base and the image portion by applying a bias with a low frequency of about 1~3 kHz to the upstream-side sleeve 41, so that a toner adhesion with a high reality is conducted on the electrostatic latent image. A bias with a high frequency of about 3~6 kHz is applied to the downstream-side sleeve 42, the toner transfer to the base is not aggressively conducted and the toner is easily moved due to the AC vibration. Therefore, the toner on the base or the surplus toner adhered on the dot portion, etc., can be laid down by the magnetic brush, so that the amount of the adhered toner can be uniform.

By applying an AC electric field to the plurality of sleeves, high-speed development is possible. The abnormal image, such as the blur occurring at the rear end of the solid image, etc., can be avoided. The base contamination can be suppressed and the grain is not obvious, so that a smooth image can be obtained.

In addition, the amplitudes (peak to peak) of the frequencies of the DC overlapping AC bias respectively applied to the upstream-side sleeve 41 and the downstream-side sleeve 42 are different.

Figure 5:
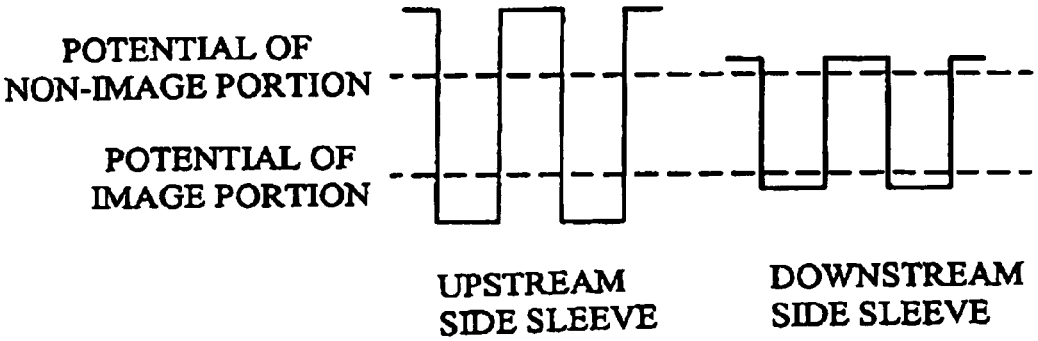
FIG. 5 is a pattern showing the bias applied to the upstream-side sleeve and the downstream-side sleeve.

FIG. 5 is a pattern showing the bias applied to the upstream-side sleeve 41 and the downstream-side sleeve 42. A sufficient amount of toner is transferred to the base and the image portion by applying a bias with an amplitude of about 800~1600V to the upstream-side sleeve 41, so that a toner adhesion with a high reality is conducted on the electrostatic latent image. A bias with an amplitude of about 400~800V is applied to the downstream-side sleeve 42, the toner transfer to the base is not aggressively conducted and the toner is easily moved due to the AC vibration. Therefore, the toner on the base or the surplus toner adhered on the dot portion, etc., can be laid down by the magnetic brush, so that the amount of the adhered toner can be uniform.

By applying an AC electric field to the plurality of sleeves, high-speed development is possible. The abnormal image, such as the blur occurring at the rear end of the solid image, etc., can be avoided. The base contamination can be suppressed and the grain is not obvious, so that a smooth image can be obtained.

In the embodiment of the present invention, two sleeves are described, but this does not limit the scope of the invention. A developing device having a plurality of sleeves can be widely used.

EXAMPLE 1

Example 1 is conducted by using the developing device shown in FIG. 2 of the present invention within a structure of the image forming device shown in FIG. 1. The photoreceptor 1 rotates with a linear velocity of 560 m/sec, and 105 sheets of image formation using a landscape A4 size can be made within one minute. The surface of the photoreceptor 1 can be uniformly charged with a voltage of −800V by the charging device 2. By being exposed with a writing density of 600 dpi using the exposure device 300, the solid image portion is −120V and an independent one dot exposure portion that is equivalent to a halftone is set at a potential of −300V. A reverse development is performed on the image portion with the negatively charged toner by using the two-component and two-stage sleeve method such that the toner and the carrier are mixed. The linear velocity of the sleeve is 1.5 times the linear velocity of the photoreceptor 1. An AC bias, which has an amplitude $V_{p-p}$ of 1200V and a frequency of 3 kHz and is overlapped with a DC component of −650V, is applied to the upstream-side sleeve 41. In addition, an AC bias, which has an amplitude $V_{p-p}$ of 1200V and a frequency of 3 kHz and is overlapped with a DC component of −350V, is applied to the downstream-side sleeve 42. In comparison with the upstream-side and the downstream-side sleeves 41, 42 applied with the same AC bias, the base contamination is reduced and a smooth image without grains can be obtained.

An AC bias, which has an amplitude $V_{p-p}$ of 1200V and a frequency of 3 kHz and is overlapped with a DC component of −650V, is applied to the upstream-side sleeve 41. In addition, an AC bias, which has an amplitude $V_{p-p}$ of 1200V and a frequency of 3 kHz and is overlapped with a DC component of −350V, is applied to the downstream-side sleeve 42. As described, in comparison with the upstream-side and the downstream-side sleeves 41, 42 applied with the same AC bias, similar to Example 1, the base contamination is reduced and a smooth image without grains can be obtained.

EXAMPLE 2

The example 2 is conducted by using the same image forming device and the developing device as the example 1. An AC bias, which has an amplitude $V_{p-p}$ of 1200V and a frequency of 2 kHz and is overlapped with a DC component of −550V, is applied to the upstream-side sleeve 41. In addition, an AC bias, which has an amplitude $V_{p-p}$ of 1200V and a frequency of 5 kHz and is overlapped with a DC component of −550V, is applied to the downstream-side sleeve 42. As described, in comparison with the upstream-side and the downstream-side sleeves 41, 42 applied with the same AC bias, similar to Examples 1 and 2, the base contamination is reduced and a smooth image without grains can be obtained.

EXAMPLE 3

The example 3 is conducted by using the same image forming device and the developing device as Example 1. An AC bias, which has an amplitude $V_{p-p}$ of 1500V and a frequency of 3 kHz and is overlapped with a DC component of −550V, is applied to the upstream-side sleeve 41. In addition, an AC bias, which has an amplitude $V_{p-p}$ of 600V and a frequency of 3 kHz and is overlapped with a DC component of −550V, is applied to the downstream-side sleeve 42. As described, in comparison with the upstream-side and the downstream-side sleeves 41, 42 applied with the same AC bias, similar to Examples 1 and 2, the base contamination is reduced and a smooth image without grains can be obtained.

As described above, according to the disclosure of the present invention, a developing device is provided to be able to prevent the abnormal image (for example, where the rear end of a solid image is blurred or a line image gets thinner). By applying an effective AC bias, high-speed development is possible. In addition, the base contamination is suppressed, so as to obtain a smooth image without obvious grains.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What is claimed is:

1. A developing device, comprising:

a plurality of magnetic sleeves configured to deposit toner onto a photoreceptor, wherein stirred toner and carriers are supported on an upstream-side magnetic sleeve and a downstream-side magnetic sleeve to form respective magnetic brushes of the stirred toner and carriers, the magnetic brushes contacting the photoreceptor to perform a developing process, wherein a developing bias that is a DC bias overlapped with an AC bias is applied to the sleeves, wherein said DC bias applied to said upstream-side sleeve is different from said DC bias applied to said downstream-side sleeve, wherein a polarity of said DC bias of said upstream-side magnetic sleeve and a polarity of said DC bias of said downstream-side magnetic sleeve are the same polarity, and wherein said developing bias that is a DC bias overlapped with an AC bias is 1–3 kHz at 800–1600V for said upstream side magnetic sleeve and 3–6 kHz at 400–800V for said downstream side magnetic sleeve.

2. A developing device, comprising:

a plurality of magnetic sleeves configured to deposit toner onto a photoreceptor, wherein stirred toner and carriers are supported on an upstream-side magnetic sleeve and a downstream-side magnetic sleeve to form respective magnetic brushes to perform a developing process, wherein a developing bias that is a DC bias overlapped with an AC bias is applied to the magnetic sleeves, wherein said DC bias applied to said upstream-side magnetic sleeve is different from said DC bias applied to said downstream-side magnetic sleeve, and wherein a polarity of said DC bias of said upstream-side magnetic sleeve and a polarity of said DC bias of said downstream-side magnetic sleeve are the same polarity, and wherein said developing bias that is a DC bias overlapped with an AC bias is 1–3 kHz at 800–1600V for said upstream magnetic side sleeve and 3–6 kHz at 400–800V for said downstream side magnetic sleeve.

3. A developing device, comprising:

a plurality of magnetic sleeves configured to deposit toner of the same color onto a photoreceptor, wherein stirred toner and carriers are supported on an upstream-side magnetic sleeve and a downstream-side magnetic sleeve to form respective magnetic brushes of the stirred toner and carriers, the magnetic brushes contacting the photoreceptor to perform a developing process, wherein a developing bias that is a DC bias overlapped with an AC bias is applied to the magnetic sleeves, wherein a frequency of said AC bias applied to said upstream-side magnetic sleeve is different from a frequency of said AC bias applied to said downstream-side magnetic sleeve, wherein a polarity of said DC bias of said upstream-side magnetic sleeve and a polarity of said DC bias of said downstream-side magnetic sleeve are the same polarity, wherein the frequency of said AC bias applied to the upstream-side magnetic sleeve is lower than the frequency of said AC bias applied to the downstream-side sleeve, and wherein the frequency of said AC bias applied to the upstream-side magnetic sleeve is 1–3 kHz and the frequency of said AC bias applied to the downstream-side sleeve is 3–6 kHz.

* * * * *